US008542853B2

(12) United States Patent
Dehe et al.

(10) Patent No.: US 8,542,853 B2
(45) Date of Patent: Sep. 24, 2013

(54) SOUND TRANSDUCER STRUCTURE AND METHOD FOR MANUFACTURING A SOUND TRANSDUCER STRUCTURE

(75) Inventors: Alfons Dehe, Neufahrn (DE); Stefan Barzen, Munich (DE); Marc Fueldner, Neubiberg (DE)

(73) Assignee: Infineon Technologies AG, Neubiberg (DE)

( * ) Notice: Subject to any disclaimer, the term of this patent is extended or adjusted under 35 U.S.C. 154(b) by 193 days.

(21) Appl. No.: 13/069,166

(22) Filed: Mar. 22, 2011

(65) Prior Publication Data

US 2011/0170735 A1 Jul. 14, 2011

Related U.S. Application Data

(62) Division of application No. 11/634,810, filed on Dec. 6, 2006, now Pat. No. 7,912,236.

(30) Foreign Application Priority Data

Nov. 3, 2006 (DE) ..... 10 2006 051 982
Nov. 22, 2006 (DE) ..... 10 2006 055 147

(51) Int. Cl.
*H04R 25/00* (2006.01)

(52) U.S. Cl.
USPC ..... 381/191; 381/175; 381/174

(58) Field of Classification Search
USPC ..... 381/190–191, 369, 173–176, 399
See application file for complete search history.

(56) References Cited

U.S. PATENT DOCUMENTS

| | | | | |
|---|---|---|---|---|
| 7,362,873 | B2 * | 4/2008 | Pedersen | 381/175 |
| 7,386,136 | B2 * | 6/2008 | Ohbayashi et al. | 381/174 |
| 7,537,964 | B2 * | 5/2009 | Minervini | 29/594 |
| 7,596,841 | B2 * | 10/2009 | Yao et al. | 29/594 |
| 7,697,707 | B2 * | 4/2010 | Akino | 381/369 |
| 7,706,554 | B2 * | 4/2010 | Ogura et al. | 381/175 |

* cited by examiner

*Primary Examiner* — Suhan Ni
(74) *Attorney, Agent, or Firm* — Maginot, Moore & Beck LLP

(57) ABSTRACT

A sound transducer structure includes a membrane, a counter electrode, and a plurality of elevations. The membrane includes a first main surface, made of a membrane material, in a sound transducing region and an edge region of the membrane. The counter electrode is made of counter electrode material, and includes a second main surface arranged in parallel to the first main surface of the membrane on a side of a free volume opposite the first main surface of the membrane. The plurality of elevations extend in the sound transducing region from the second main surface of the counter electrode into the free volume.

4 Claims, 9 Drawing Sheets

SOUND TRANSDUCER STRUCTURE AND METHOD FOR MANUFACTURING A SOUND TRANSDUCER STRUCTURE

CROSS-REFERENCE TO RELATED APPLICATIONS

This application is a divisional of U.S. patent application Ser. No. 11/634,810, filed Dec. 6, 2006, which claims priority from German Patent Applications No. 10 2006 051 982.5, which was filed on Nov. 3, 2006, and No. 10 2006 055 147.8, which was filed on Nov. 22, 2006, all of which are incorporated herein by reference in their entireties.

BACKGROUND

The present invention relates to a sound transducer structure and to a method for manufacturing it and, in particular, to how different sound transducer structures can be manufactured and how geometries and characteristics of the sound transducer structures can be adjusted to fulfill different requirements to the sound transducer structures.

Sound transducer structures are used in a plurality of applications, such as, for example, in microphones or loudspeakers, these two principally only differing in that in microphones sound energy is converted to electric energy and in loudspeakers electric energy is converted to sound energy. Since sound transducers detect or generate dynamic pressure changes, the invention also relates to pressure sensors.

In general, sound transducers, such as, for example, microphones, are to be manufacturable at low cost and be as small as possible. Due to these requirements, microphones and sound transducers are often produced in silicon technology, wherein due to the different desired fields of application and sensitivities, there are a plurality of potential configurations of sound transducers each comprising different geometrical configurations. Microphones, for example, may be based on the principle of measuring a capacity. A movable membrane which is deformed or deflected by pressure changes is arranged in a suitable distance to a counter electrode such that a change in capacity resulting from a deformation or deflection of the membrane between the membrane and the counter electrode may be used to draw conclusions as to pressure or sound changes. Such a structure is typically operated by a bias voltage, i.e. a potential which may be adjusted freely to the respective circumstances is applied between the membrane and the counter electrode.

Other parameters determining the sensitivity of such a microphone or the signal-to-noise ratio (SNR) of the microphone are, for example, rigidity of the membrane, diameter of the membrane or rigidity of the counter electrode which may also deform under the influence of the electrostatic force between the membrane and the counter electrode. Different possibilities result depending on the profile of requirements (for a finished processed sound transducer), such as, for example, a combination of low a desired operating voltage with medium mechanical sensitivity, a combination of low an operating voltage with high mechanical sensitivity or a combination of high an operating voltage with medium mechanical sensitivity.

In addition to the mechanical characteristic of the materials used, particularly high a requirement is often made as to the manufacturing tolerance of the membrane diameter or membrane dimension which has considerable influence on the characteristics of a microphone. This will be of particular relevance if several microphones are to be used in an array and consequently must have characteristics as identical as possible. Often, a microphone chip the membrane of which is accessible from both sides is glued onto a substrate in a sound-proof manner. Thus, a back volume forming a cavity is sealed by one side of the membrane. The characteristics of the cavity formed are decisive for the sensitivity and the SNR of the microphone since the cavity counteracts the deflection or deformation of the membrane and can attenuate this movement since the membrane in a sense has to act against a volume of a certain "viscosity". The diameter of the membrane in relation to the cavity volume given plays an important role for a quantitative estimation of this effect.

Considering the plurality of elements possible and the plurality of parameters, the problem arising often is that production lines by means of which it is possible to manufacture the most different sound transducer structures have to be provided.

SUMMARY

According to an embodiment of the present invention, a sound transducer structure is produced by applying membrane support material on a membrane carrier material; applying membrane material in a sound transducer region and an edge region on a main surface of the membrane support material; applying counter electrode support material on a main surface of the membrane material; producing recesses in a main surface of the counter electrode support material in the sound transducer region; applying counter electrode material on the first main surface of the counter electrode support material; and removing membrane carrier material and membrane support material in the sound transducing region to a second main surface of the membrane material.

BRIEF DESCRIPTION OF THE FIGURES

Embodiments of the present invention will be detailed subsequently referring to the appended drawings.

DETAILED DESCRIPTION

Figure 4:
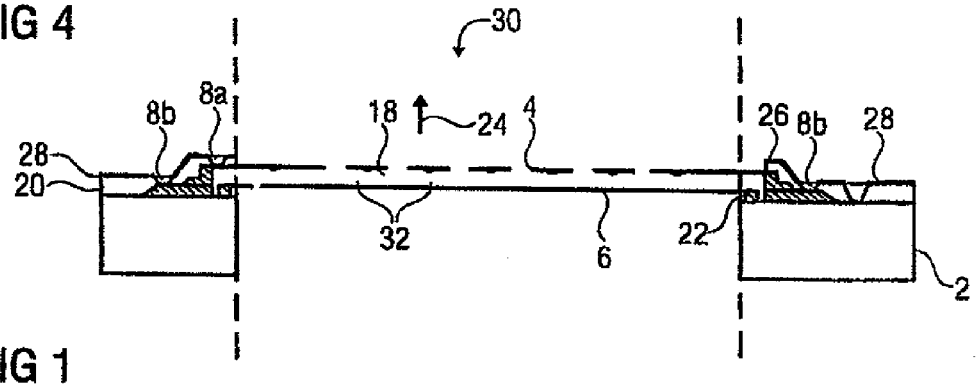
FIG. 4 shows a sectional view of an embodiment of the present invention.

Different embodiments of the present invention will be discussed subsequently referring to FIGS. 1 to 10, wherein in the drawings identical reference numerals are given to objects having an identical function or similar function so that objects referred to by identical reference numerals within the different embodiments are exchangeable and the description thereof is mutually applicable.

The same applies to the embodiments of inventive methods for manufacturing a sound transducer structure described referring to FIGS. 10 to 15.

Figure 1:
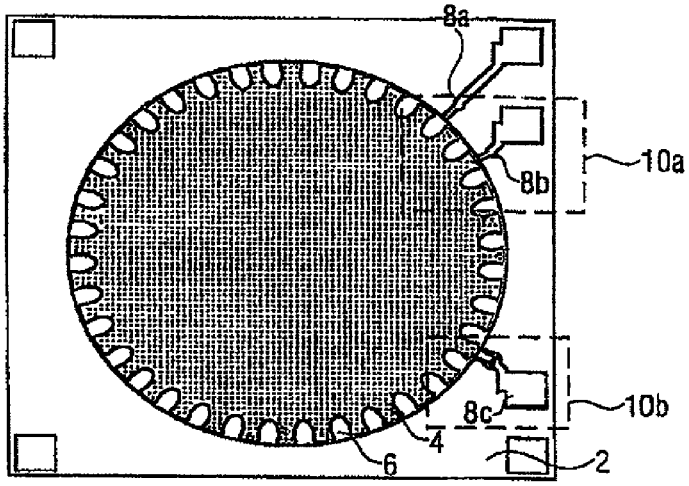
FIG. 1 shows a top view of an embodiment of an inventive sound transducer structure.

FIG. 1 shows a top view of an embodiment of the present invention. Since FIGS. 2*a*, 2*b* and 3 each show section enlargements of the top view of the embodiment of FIG. 1, FIGS. 1, 2*a*, 2*b* and 3 will be discussed together in the following paragraphs.

FIG. 1 shows a microphone implemented in silicon technology on a carrier substrate (wafer) 2 as an embodiment of the present invention.

FIG. 1 shows a counter electrode 4 below which a membrane 6 is arranged, and electrical contacting pads 8*a*, 8*b* and 8*c* serving, as will be described below, for contacting the microphone, in particular the counter electrode and the membrane.

Figure 2A:
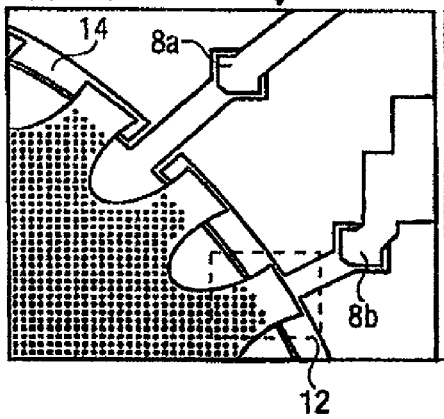
FIGS. 2*a*, 2*b* show section enlargements of the embodiment shown in FIG. 1.
Figure 2B:
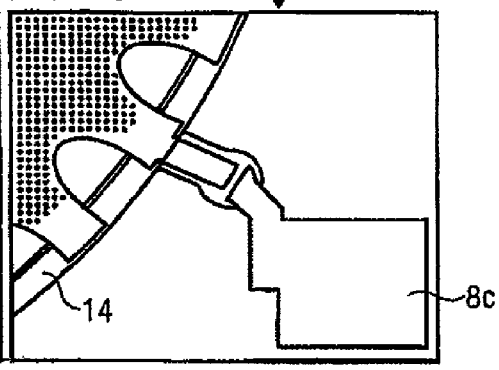

FIG. 1 additionally shows contact regions 10*a* and 10*b* which include the contacts 8*a*, 8*b* and 8*c* and section enlargements of which are illustrated in FIGS. 2*a* and 2*b*.

Figure 3:
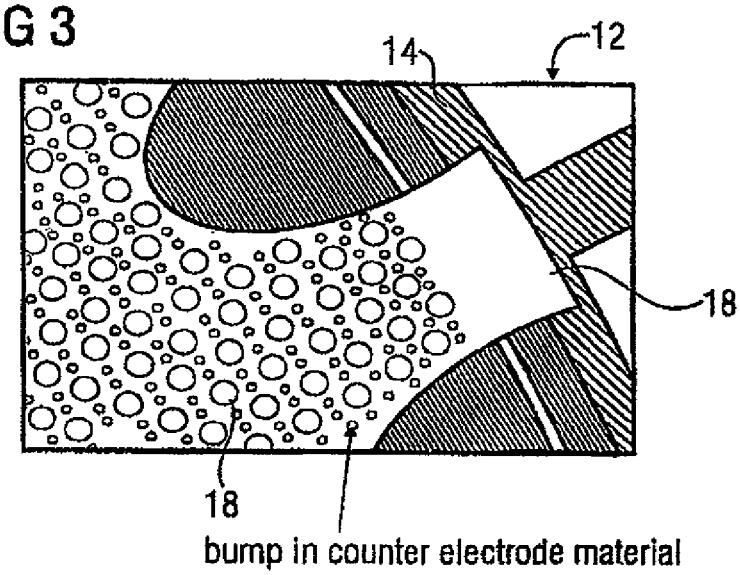
FIG. 3 shows another section enlargement of the embodiment shown in FIG. 1.

FIG. 2*a* in turn shows a guard terminal region 12 a section enlargement of which is shown in FIG. 3.

As has already been described above, sound transducing in the inventive embodiment of a silicon microphone is based on a membrane 6 being deflected relative to a fixed counter electrode 4 and the resulting change in capacity between the membrane 6 and the counter electrode 4 being detected as a measured quantity. A number of requirements are made to the membrane 6, the counter electrode 4 and contacting thereof, which will be described shortly below and in greater detail referring to FIGS. 1 to 3. Since there is no principle limitation as to the material of the membrane 6 and the counter electrode 4 and the carrier substrate 2, the material of the membrane will subsequently generally be referred to as membrane material and the material of the counter electrode 4 as counter electrode material. In one embodiment, the membrane 4 and the counter electrode 6 are made of polysilicon which might be doped in a suitable manner to generate desired mechanical characteristics.

In general, the membrane 6 has to be arranged to be movable relative to the counter electrode 4, requiring it to be arranged above a free volume which in this sectional view cannot be seen for reasons of perspective, but is arranged below the membrane 6. In the sectional views of further embodiments of the present invention shown in FIGS. 4 to 9, this volume can be recognized. The influence of the volume, in particular of the quantity thereof, to the signal parameters of the microphone will be discussed in this context.

The least requirement to wiring the embodiment of the present invention of FIG. 1 is contacting the counter electrode 4 and the membrane 6, wherein in the embodiment shown a contact 8*a* allows electrical contacting of the membrane 6, as is shown in FIG. 2*a*. In addition, a contact 8*c* allows contacting the counter electrode 4, as is shown in FIG. 2*b*. In addition, FIG. 2*a* shows a contact 8*b* serving to contact a guard structure 14 surrounding the membrane 6, as can be seen in FIGS. 2*a*, 2*b* and 3. The guard structure 14 serves to suppress a static inhomogeneous portion of the capacity measurement, as is unavoidable due to the geometrical arrangement of the membrane 6 and the counter electrode 4. It is to be mentioned here that the membrane has two regions differing in function due to the construction principle. In an edge region 16 illustrated in FIG. 3, the membrane cannot move since it is mechanically connected to the carrier substrate 2 in this edge region. The counter electrode 4, too, has to be connected mechanically to the carrier substrate 2, which can be seen in the inventive embodiment in FIGS. 2*a*, 2*b* and 3.

In general, it is a goal when constructing a microphone to achieve the highest signal-to-noise ratio (SNR) possible. Among other things, this can be achieved when the change in capacity to be measured is as great as possible compared to the static capacity of the assembly to which no pressure is applied. This may, among other things, be achieved by forming the membrane to be as thin as possible so that it will deform significantly with slight changes in pressure (small sound pressure levels). In this context, the edge regions 16 are important in which unavoidably a static capacity forms between the membrane 6 and the counter electrode 4 which cannot be changed since the distance from the counter electrode 4 to the membrane 6 is fixed. The greater this static portion of the capacity relative to the overall capacity, the smaller the SNR.

Thus, for optimizing purposes, the counter electrode 4 in the inventive embodiment is not connected to the carrier substrate along its entire circumference but only to connective elements 18 arranged in an equidistant manner which are exemplarily enlarged in FIG. 3. The result is smaller an overlapping area of the membrane 6 and the counter electrode 4 and, resulting therefrom, smaller a static capacity portion than in the case of complete overlapping. To further minimize the influence of the static capacity, the guard structure 14 is provided further reducing, when wired suitably, the influence of the static capacity.

As can be seen clearly in FIG. 3, the counter electrode 4 has a number or recesses 18 extending through the counter electrode material and in a way perforating the counter electrode. This is provided for in the inventive embodiment to allow changes in pressure incident on the membrane to reach the membrane 6 in an undisturbed manner. Alternatively, it would be possible to attach the membrane 6 above the counter electrode 4. However, the membrane 6 is by far the most sensitive device of the microphone due to the desired deformability so that the disclosed solution offers the great advantage of mechanical protection of the membrane 6 since the more rigid counter electrode 4 is that layer facing in the direction of the surroundings.

A piston-like movement of the membrane 6 would be desirable for an idealized measurement free of disturbances. If the membrane as a whole moved relative to the counter electrode 4 without deforming, a linear connection would result between an (infinitesimal) change in deflection and the capacity measured, in analogy to a plate capacitor.

Due to the highly integrated assembly of the inventive embodiment of a silicon microphone, this requirement can only be fulfilled approximately. To increase mechanical sensitivity, i.e. the ability of reacting to slight sound pressure changes, the thickness of the membrane may, for example, be reduced. At the same time, the inventive embodiment of the microphone may be operated by different operating voltages, i.e. different voltages may be applied between the counter electrode 4 and the membrane 6. Due to the electrostatic attraction resulting between the counter electrode 4 and the membrane 6, the sensitivity of the membrane or the entire arrangement may also be varied. However, a problem might result in that with too high a voltage the counter electrode 4 may also be deformed under the influence of the electrostatic force, which as far as reproducibility of the measurements is concerned is not desirable.

The reduction in the membrane's thickness is limited on the one hand by the stability of the membrane itself (destruction with too high a sound pressure or too high a voltage). On the other hand, with too strongly bending a membrane there is the danger that it is deflected to the counter electrode and sticks thereto due to adhesion forces. Another parameter which may be varied when designing embodiments of an inventive microphone and have considerable influence on the measuring results, is the membrane's diameter. When producing a plurality of microphones, it is ideally to be kept to exactly to ensure reproducibility of a measurement of several inventive microphones. This will be of particular relevance if several inventive microphones are to be operated in an array.

As has been described above, there are a number of geometrical boundary conditions which are to be considered when designing a microphone or sound transducer structure and have to be kept to with high precision. Ways of complying with individual boundary conditions or providing a microphone optimized for the intended purpose of usage by means of suitable design measures will be indicated in the embodiments of the present invention described below.

Thus, at least one embodiment of the present invention offers the great advantage that all the design options can be realized in a single manufacturing process since it has complete modularity. At least one embodiment of the present invention allows a unique way of implementing individual ones of the options described subsequently without preventing realizing an option by omitting another option. Embodiments of the inventive manufacturing process or inventive manufacturing method described below are such that all the microphone variations can be manufactured by the smallest possible number of steps. Depending on the demands, submodules may be implemented or omitted.

FIG. 4 shows an embodiment of the present invention in which the mechanical characteristics of the membrane can be varied by varying the thickness thereof and by implanting suitable dopants into the membrane.

FIG. 4 shows an embodiment of an inventive sound transducer structure formed on a carrier substrate (wafer) 2. The sectional view shown in FIG. 4 which may, for example, be a projection or sectional view of the embodiment shown in FIG. 1 shows the membrane 6 and the counter electrode 4 having recesses 18 already described before.

In addition, FIG. 4 shows contactings 8*a* and 8*b* extending from a main surface of the sound transducer structure to the counter electrode material forming the counter electrode or guard structure 14 through an intermediate layer 20 which may have been applied to be able to electrically contact the structures.

In this context, it is to be pointed out that in order to unambiguously refer to the relevant surfaces of the three-dimensional material layers mentioned in connection with this embodiment of the invention, the term main surface will subsequently refer to those surfaces the area normal of which is parallel or anti-parallel to the setup direction 24 indicated in FIG. 4. This means that this refers to those areas having the greatest portion of the surface area of the layers or layer-like structures discussed.

In particular, the term first main surface subsequently means that surface the area normal of which is in the direction of the setup direction 24. The setup direction 24 here indicates that direction in which individual subsequent layers of the sound transducer structure are applied on the surface of the carrier substrate 2 during manufacturing. In analogy, the term second main surface refers to those surfaces the area normal of which is opposite to the setup direction 24.

A second oxide layer 26 on which the counter electrode 4 is arranged and which mechanically supports the same is arranged on the first main surface of the membrane 6, in the edge region. Since the second oxide layer 26 serves supporting the counter electrode 4 and, among other things, the thickness thereof determines the spacing between the counter electrode 4 and the membrane 6, the term second oxide layer will subsequently be used as a synonym to the term counter electrode support material to emphasize the function of the second oxide layer. According to an embodiment of the present invention, the thickness of the counter electrode support material 26 exemplarily is between 1000 nm and 3000 nm or between 500 nm and 3000 nm to achieve the desired functionality of an embodiment of an inventive microphone.

In another embodiment of the present invention, the thickness of the membrane 6 or the membrane material is 100 nm to 500 nm or 100 nm to 1000 nm. In another embodiment of the present invention, the thickness of the membrane support material is between 100 nm and 1000 nm to achieve the desired membrane support.

In another embodiment of the present invention, the thickness of the counter electrode material is 600 nm to 1800 nm or 500 nm to 2500 nm to achieve the required stability of the counter electrode 4.

In order to protect the embodiment of the inventive sound transducer assembly of FIG. 4 against environmental influence, optionally an insulating intermediate layer 20 which can additionally level out unevenness is applied. Additionally, a passivation 28 may be mounted to the surface of the sound transducer structure.

As has been described above, the membrane 6 is fixed or connected to the carrier substrate 2 in the edge region 16 via the membrane support material 22 so that under sound pressure the membrane 6 can move or deform only in the sound transducer region 30 delineated in FIG. 4 by broken lines.

In the embodiment of the present invention shown in FIG. 4, a plurality of elevations (bumps) 32 are arranged on the second main surface of the counter electrode 4 on the counter electrode 4 within the sound transducing region 30 so that these bumps are in the direction of the membrane 6.

Sticking of the membrane 6 to the counter electrode 4 can be prevented by the bumps 32 even if it is deflected to such an extent that it mechanically contacts the counter electrode 4.

Compared to the possibility of arranging bumps on the surface of the membrane 6 itself, the inventive embodiment of FIG. 4 is of advantage in that when arranging the bumps 32 on the counter electrode 4, the inert mass of the membrane 6 is not increased by the bumps. This would cause a decrease in sensitivity and would be particularly unproductive if the membrane 6 was thin and thus easily deformable, and thus had a small inert mass.

Thus, in the embodiment of the present invention shown in FIG. 4, the sensitivity of the membrane, i.e. mechanical stress of the membrane, can be fixed alone by the thickness and implantation of the membrane 6.

In an embodiment of the present invention, amorphous silicon which is doped with phosphorus is used as the membrane material. After doping, crystallization is performed which allows polycrystalline, doped silicon to form by annealing. Thus, the doping and annealing determine the stress in the material.

In another embodiment of the present invention, the counter electrode is made of a metal layer which may additionally be reinforced with silicon nitride.

The following embodiments of the present invention illustrated in FIGS. 5 to 9 show further ways of optimizing a sound transducer as to its characteristics. Thus, numerous components in the following embodiments have an identical function or are of an identical geometrical shape as corresponding components of FIG. 4, so that when discussing the subsequent embodiments, repeated discussion of identical components will be dispensed with, wherein additionally for reasons of clarity the reference numerals relating to these components will not be indicated.

Figure 5:
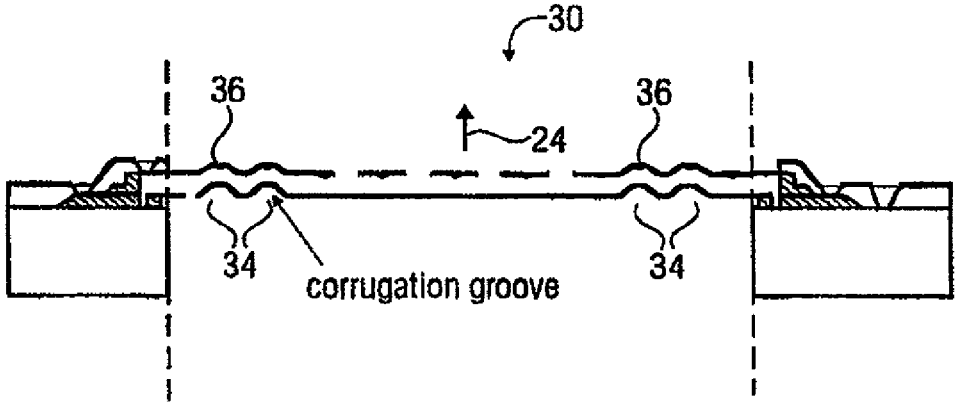
FIG. 5 shows a sectional view of another embodiment of the present invention.

FIG. 5 shows an embodiment of the present invention wherein the mechanical compliance of the membrane or the ability thereof to be deflected in parallel to the setup direction 24 is improved by corrugation grooves 34 formed by the round membrane in a concentric arrangement in the sound transducing region.

A corrugation groove is a structure of the membrane 6 forming a closed contour in the membrane material. In the embodiment of FIG. 5, the corrugation grooves are formed in the direction of the counter electrode 4. This is of advantage in that the compact setup of the embodiment of the present invention of FIG. 5 having the counter electrode 4 above the membrane 6 is made possible. If the corrugation groove 34 were arranged opposite to the setup direction 24, the height of the entire setup would increase in that the thickness of the membrane support material 22 would have to be increased such that the contour of the corrugation grooves 34 can be formed completely within the membrane support material 22 during production.

The fact that the corrugation grooves 34 and bumps 32 are not both arranged on the membrane 6 has the great advantage that all options are left open in the manufacturing method to be described below, i.e. corrugation grooves 34, bumps 32 or both structures can be produced, wherein omitting one component does not influence the production process negatively.

In addition, the embodiment of the invention of FIG. 5 has the advantage that due to the fact that the corrugation grooves 34 and bumps 32 are mounted to opposite main surfaces of the membrane 6 and the counter electrode 4 in an orientation facing each other, bumps 32 may also be mounted within the corrugation negative shape 36 representing the shape of the corrugation grooves 34. Thus, sticking of the membrane 6 to the counter electrode 4 can be prevented efficiently, even in the region of the corrugation grooves 34.

In another embodiment of the present invention, the corrugation grooves are raised from the surface of the membrane by 300 nm to 2000 nm or 300 nm to 3000 nm.

Figure 6:
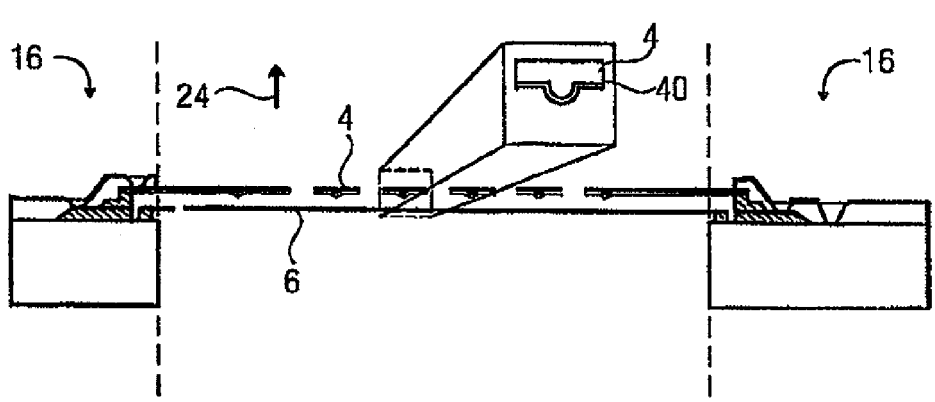
FIG. 6 shows a sectional view of another embodiment of the present invention.

In the embodiment of the present invention shown in FIG. 6, a layer of stability improving material 40 comprising higher a mechanical tensile stress than the counter electrode material 4 is applied to the second main surface of the counter electrode 4. By means of the embodiment of the present invention described in FIG. 6, the field in which a microphone or a sound transducer structure may be employed can be extended considerably since the mechanical rigidity of the counter electrode 4 can be improved considerably by only a single additional process step. In this way, an embodiment of an inventive sound transducer structure may be operated both at low voltages (such as, for example, smaller than 3 Volt) and high electrical bias voltages (exemplarily >5 V) where the bending of a counter electrode 4, without any stability improving material 40, is no longer negligible. Thus, the embodiment shown in FIG. 4 has the advantage compared to simply increasing the thickness of the counter electrode 4 that the rigidity of the counter electrode 4 is increased considerably without impeding the evenness of the thickness profile of the counter electrode 4, which would inevitably be the case when significantly increasing the thickness of the counter electrode 4 due to process variations. Another considerable advantage is that the time-consuming and expensive deposition of a thick layer of counter electrode material can be avoided, considerably increasing the overall process efficiency. This also avoids complicated patterning (etching) of such thick layers in further process steps.

In the inventive embodiment, the counter electrode 4 also becomes more rigid with the thickness of the stability improvement material 40, the possible increase in thickness here only being limited by the resulting topology. Different materials may be used here for precisely dimensioning the improvement in rigidity, wherein two different effects may be utilized here. On the one hand, materials may be used which themselves have a considerably higher layer stress than, for example, silicon which may be used for forming the counter electrode 4 (polysilicon), which has a layer stress of <100 MPa. If, for example, silicon nitride ($Si_3N_4$) is used for increasing the rigidity, a thin layer will already be sufficient to achieve a significant increase in the bending rigidity of the counter electrode 4 since a thin silicon nitride layer has a typical layer stress of 0.5 to 1 GPa.

In another embodiment of the present invention, silicon oxy nitride $Si_xO_yN_z$, having a low oxygen content is used as a stability improvement material 40. In another embodiment of the present invention, silicides, such as, for example, WSi, are used as a stability improvement material.

In a modular manufacturing method, applying the additional layer of stability improvement material 40 is simply possible by applying, before applying the counter electrode material 4, a thin layer of stability improvement material 40 which in one embodiment of the present invention consists of silicon nitride which additionally has high an etching selectivity and can thus at the same time serve as an etch stop when removing the counter electrode support material 26 between the membrane 6 and the counter electrode 4.

The high flexibility of embodiment of the inventive method and embodiments of the inventive overall concept also allows providing most different materials as stability improvement materials 40, wherein polycrystalline materials may, for example, be selected, also due to their lattice constants, to form a stability-improving layer of stability improvement material 40. If materials having slightly different lattice constants are used, even warping of the counter electrode in the setup direction 24 may be produced by deposition at the interface between the stability improvement material 40 and the counter electrode support material 4.

In another embodiment of the present invention, the thickness of the stability improvement material is between 10 nm and 300 nm or between 10 nm and 1000 nm.

In another embodiment of the present invention, a ratio of the thickness of stability improvement material and the counter electrode material is between 0.005 and 0.5.

In another embodiment of the present invention, any other semiconductor nitrides and semiconductor oxides, such as, for example, GaN, are used as a stability improvement material.

Figure 7:
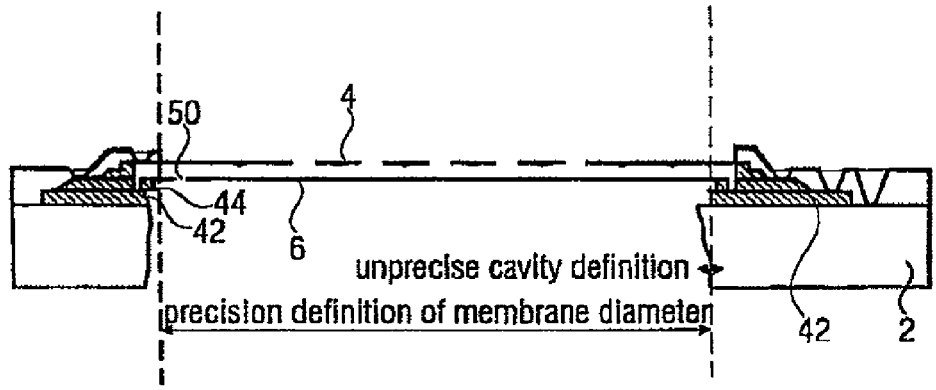
FIG. 7 shows a sectional view of another embodiment of the present invention.

FIG. 7 shows an embodiment of the present invention in which the diameter of the membrane 6 can be set in an extremely precise and reproducible way. In order to achieve this, in the embodiments of the present invention shown in FIGS. 7, 8 and 9 an additional layer of a membrane support material 42 is arranged between the carrier substrate 2 and the membrane 6, which may be patterned by photolithographic methods. For production-technological reasons, an additional membrane carrier support material 44, such as, for example, in the form of a third oxide layer, is arranged between the membrane carrier material 42 and the carrier substrate 2. High precision of the freely movable membrane diameter can be achieved by the photolithographically patternable membrane carrier material 42 since the precision of photolithographic methods is better than 1 μm. If, however, the unsupported area of the membrane 6 is only defined by wet-chemical or dry etching of the carrier substrate 2 at the end of the manufacturing process, the maximally achievable precision typically is at most +/−20 μm.

In a general case, the lateral walls of the carrier substrate 2 having formed by etching and limiting a free volume below the membrane 6 will have an, within certain limits, erratic shape. If the membrane carrier material 42 which is etching-resistive is missing, the unsupported membrane diameter of a membrane 6 will be determined by the etch process and thus be little precise.

Figure 8:
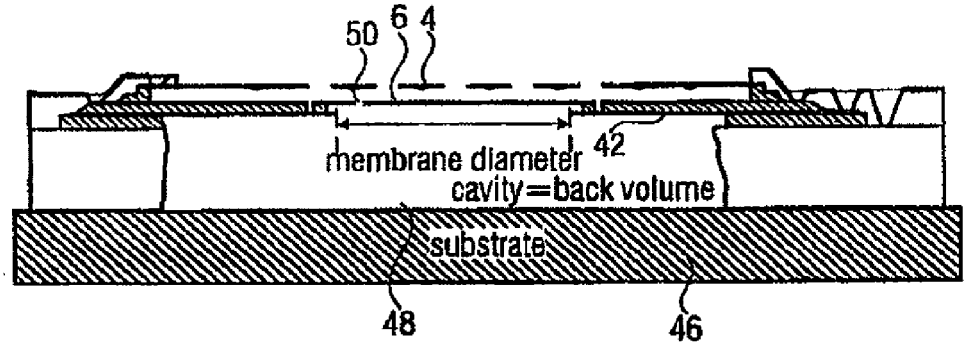
FIG. 8 shows a sectional view of another embodiment of the present invention.

As is the case in the embodiment of the invention shown in FIG. 8, the unsupported diameter of the membrane 6 can be varied within broad limits. This will be of particular relevance, if, as is shown in FIG. 8, an embodiment of an inventive sound transducer structure is glued onto another substrate 46 in an air-tight manner so that a closed volume 48 (cavity) forms below the membrane 6. In this case, reducing or adjusting the unsupported membrane diameter of the membrane 6 may have an effect on the maximum microphone sensitivity in two respects.

To begin with, it should be noted that in the case shown in FIG. 8 when being deformed the membrane additionally has to compress the gas volume sealed in the cavity 48, which influences the deflection behavior of the membrane 6. According to an embodiment of the present invention, the membrane 6 thus comprises at least one pressure compensation opening 50 which allows performing pressure compensation between the cavity volume and ambient pressure with a slow change in ambient pressure. Thus, an embodiment of an inventive sound transducer structure is equally sensitive to relative pressure changes, even with a time-variable absolute ambient pressure. The high-pass characteristic of the embodiment of the inventive sound transducer structure resulting from this arrangement may, for example, also be varied by the size of the pressure compensation opening 50.

If the membrane diameter in FIG. 8 is reduced, higher a polarization voltage (operating voltage) can be operated with, with an accompanying reduced movability or ability of deflecting the membrane 6. Thus, the acoustic rigidity of the membrane spring in relation to the spring formed by the cavity volume enclosed and representing a disturbing quantity becomes greater and thus the signal will improve if all the other operational parameters remain unchanged.

If the movability of the membrane, when reducing the membrane diameter, is, for example, compensated by using thinner a membrane and if the same polarization voltage is used, the signal will also be maximized. Again, the ratio of the acoustic rigidity of the membrane and the rigidity of the cavity volume will improve.

Figure 9:
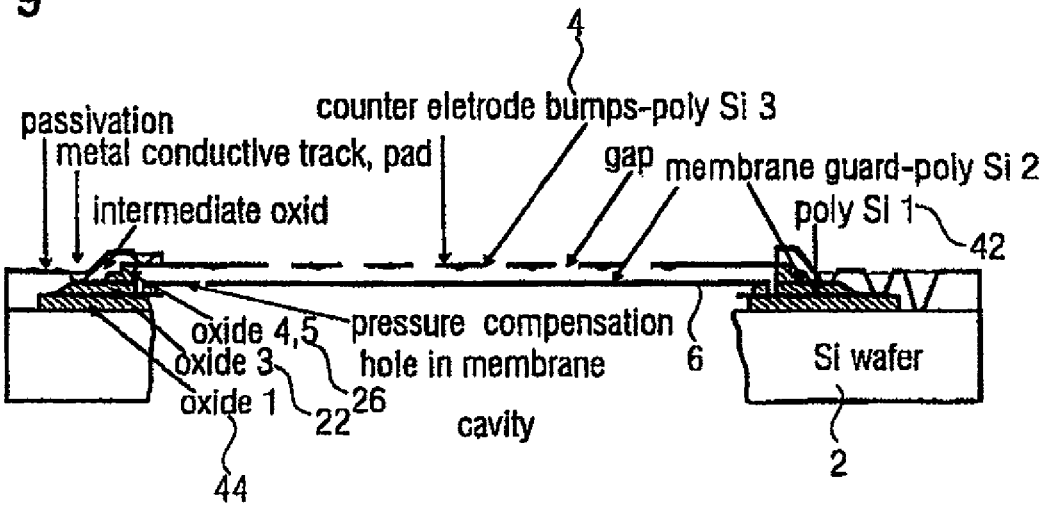
FIG. 9 shows a sectional view of another embodiment of the present invention.

FIG. 9 shows an embodiment of the present invention in which some of the characteristics of the previous embodiments are shown in combination so that the extraordinarily high variability and flexibility of the inventive concept or the inventive method for manufacturing a sound transducer structure can be made out clearly.

Thus, the embodiment of the present invention shown in FIG. 9 is produced in silicon technology so that the carrier substrate is a silicon wafer, wherein the membrane carrier support material 44, the counter electrode support material 26 and the membrane support material 22 are made of silicon oxide. At the same time, the membrane material 6, the counter electrode material 4 and the membrane carrier material 42 is polysilicon. Thus, the polysilicon can be provided with an implantation in the manufacturing method to adjust the rigidity of the material corresponding to the demands. Thus, phosphorus may, for example, be used as a suitable implantation material.

The combination of several characteristics of the embodiments of FIGS. 1 to 8 shown in FIG. 9 underlines the high flexibility of the inventive concept and, in particular, of the different embodiments of the inventive manufacturing method, as will be discussed subsequently referring to FIGS. 10 to 15.

High modularity or flexibility of the embodiments of the inventive methods for manufacturing a sound transducer structure (MEMS process) is decisive which allows manufacturing sound transducer structures, such as, for example, microphones, for different applications by one and the same technology. Thus, microphones can, for example, be produced having high or low sensitivities, wherein they can at the same time be produced in a highly precise and cheap manner. Aspects which may optionally be implemented are:

robust membrane electrode including corrugation robust membrane electrode without corrugation counter electrode stabilized using stability improvement material additional bottom membrane carrier layer (such as, for example, polysilicon) for making the membrane diameter more precise or for optimizing the ratio of membrane diameter and cavity volume Before examples of embodiments of inventive methods for manufacturing sound transducer structures will be discussed in greater detail using flow charts and schematic illustrations, the procedure when manufacturing inventive sound transducer structures will be discussed briefly referring to FIG. 10.

Figure 10:
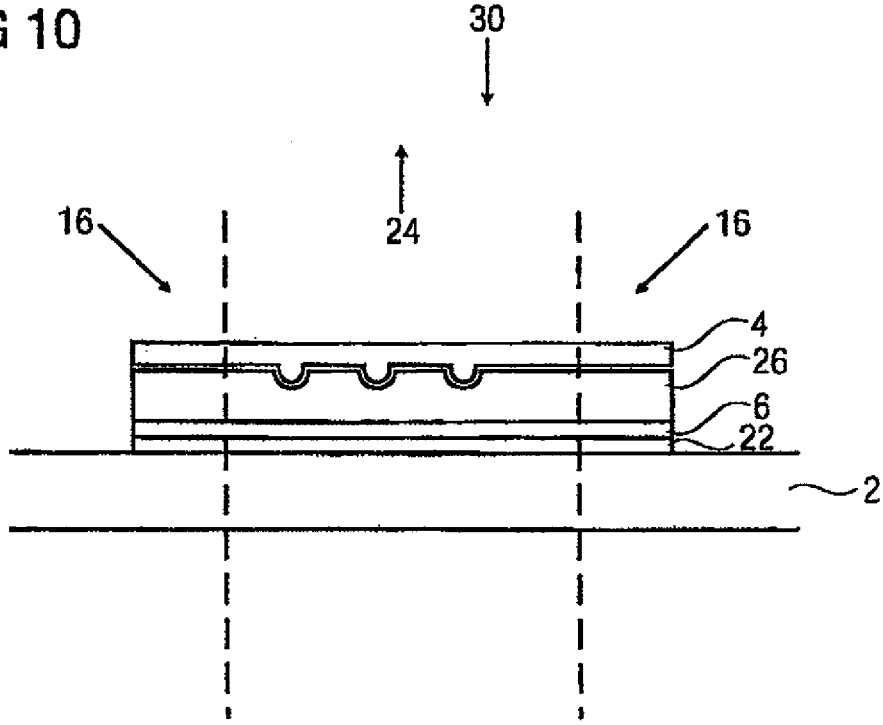
FIG. 10 shows a sectional view of a configuration of an embodiment of the present invention during manufacturing.

The sound transducer structure is set up successively in a setup direction 24 on the carrier substrate, wherein a layer sequence as may, for example, occur during production of the embodiment shown in FIG. 4 is illustrated in FIG. 10. At first, the membrane support material 22 is applied on the carrier substrate 2 in the edge region 16 and the sound transducing region 30. Onto the membrane support material 22, a layer of membrane material 6 is applied onto which in turn a layer of counter electrode support material 26 is applied. The counter electrode support material is patterned in the sound transducing region 30 such that recesses or impressions representing the negative shape for bumps formed by applying the counter electrode material 4 in the negative shapes are produced in the counter electrode support material 26. This successive setup of the sound transducer structure here takes place in a direction of the setup direction 24. Before completion, the cavity is etched from the backside, i.e. from the side of the carrier substrate 2 opposite to the setup direction 24, i.e. the carrier substrate and the membrane support material are removed in the sound transducing region 30 to the membrane 6. The same applies for the counter electrode support material 26 arranged between the counter electrode 4 and the membrane 6 so that the unsupported membrane 6 can move in the sound transducing region 30 in the setup direction 24.

Figure 11:
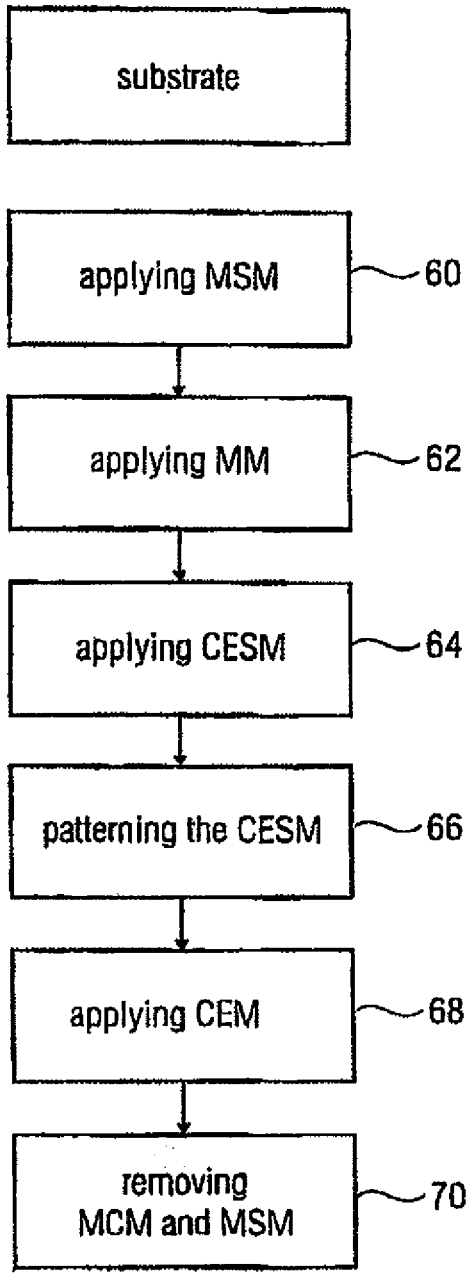
FIG. 11 shows a flow chart of an embodiment of the inventive method for manufacturing a sound transducer structure.

An embodiment of a method for manufacturing a sound transducer structure is illustrated in the flow chart of FIG. 11.

The process starts from a carrier substrate 2 or wafer exemplarily illustrated in FIG. 10.

In a first step 60, membrane support material 22 (MSM) is applied to a first main surface of a membrane carrier material (MCM). As will be explained in greater detail below referring to FIG. 12, the membrane carrier material may be directly the carrier substrate 2 or a membrane carrier material 42 in the meaning of FIG. 7 or 8 since a plurality of different options can be realized by one process according to an embodiment of the invention.

In a second step 62, membrane material (MM) is applied in a sound transducing region 16 and edge region 30 on a first main surface of the membrane support material 22 opposite the first main surface of the membrane carrier material.

In a third step 64, counter electrode support material 26 (CESM) is applied to a first main surface of the membrane material 6 opposite the first main surface of the membrane support material 22.

In a fourth step 66, the counter electrode support material 26 is patterned by producing a plurality of recesses in a first main surface of the counter electrode support material 26 opposite the first main surface of the membrane material 6 in the sound transducing region.

In a fifth step 68, counter electrode material 4 (CEM) is applied to the first main surface of the counter electrode support material 26.

In a sixth step 70, membrane carrier material 2 and membrane support material 22 are removed in the sound transducing region 30 to a second main surface of the membrane material 6 abutting on the first main surface of the membrane support material 22.

As has already been mentioned, it is a great advantage of the embodiments of inventive methods for manufacturing a sound transducer structure that these have great modularity. Thus, many individual steps may be combined with one another freely without unavoidably excluding of another optional step or another optional module when adding an individual step or module.

This will be explained in greater detail below referring to FIG. 12 in which several optional embodiments of inventive methods for manufacturing a sound transducer structure are illustrated. In particular the mode of functioning or assembly of individual functional steps in the process flow is illustrated and, when necessary, the individual process steps are explained in greater detail referring to FIGS. 13, 14 and 15.

Method steps being identical to the example shown in FIG. 11 will be provided with the same reference numerals so that the description of these method steps may also be applied to FIG. 12, which is why a description of these steps will be omitted subsequently to avoid duplication.

Figure 12:
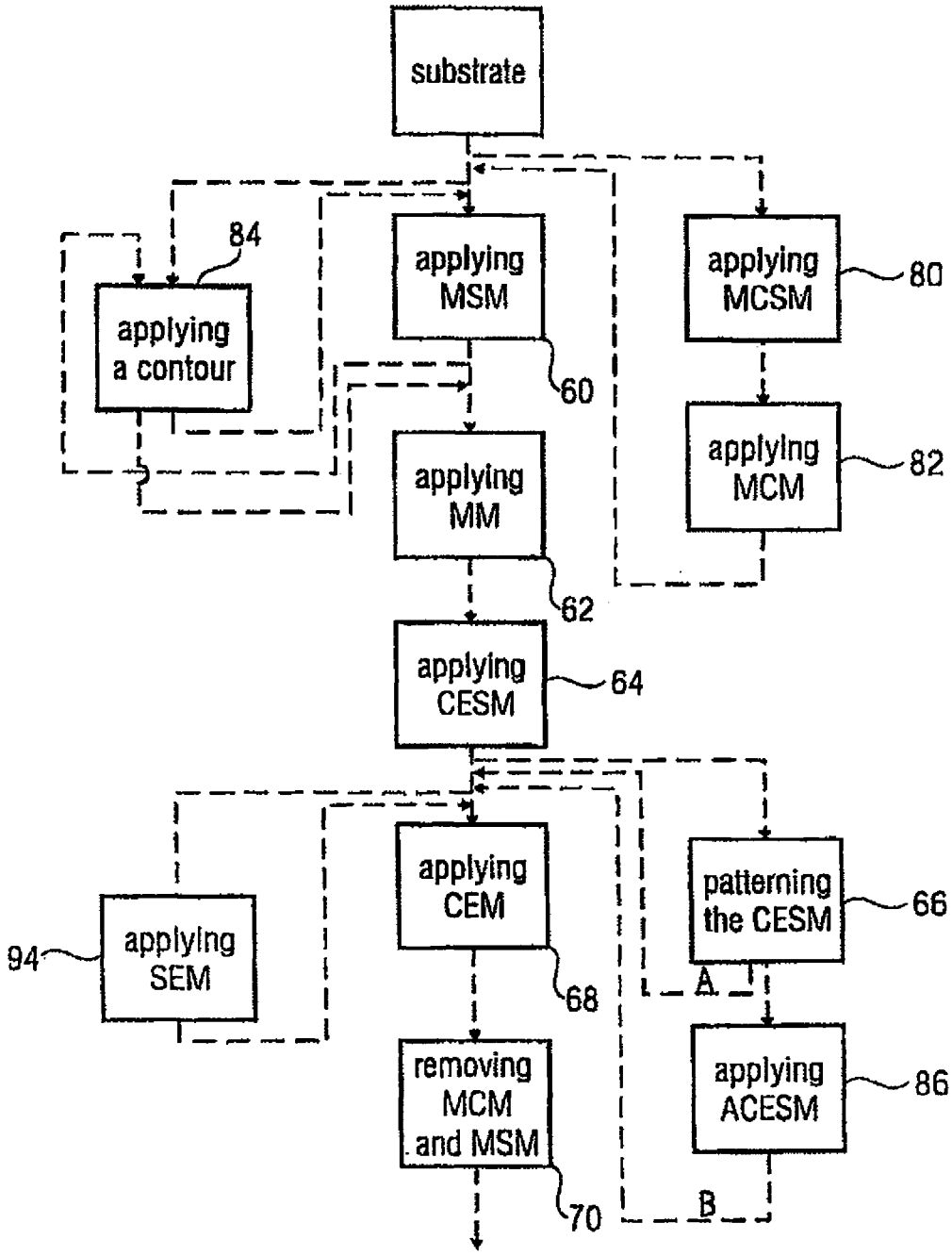
FIG. 12 shows a flow chart of another embodiment of the inventive method for manufacturing a sound transducer structure.

In FIG. 12, all the optional method steps or modules to be used optionally are indicated in the process flow in broken lines to underline the fact that they are optional.

The first options already result before the first step 60, i.e. before applying the membrane support material when the feature shown in the embodiments of FIGS. 7 and 8 of precise definition of the membrane diameter is necessary. In a first optional step 80, membrane carrier support material 44 (MCSM) may be applied to a first main surface of a carrier substrate 2 parallel to the first main surface of the membrane carrier material. In a second optional step 82, membrane carrier material 42 (MCM) is applied to the first main surface of the membrane carrier support material 44 to form the structure defining the membrane diameter.

Figure 13:
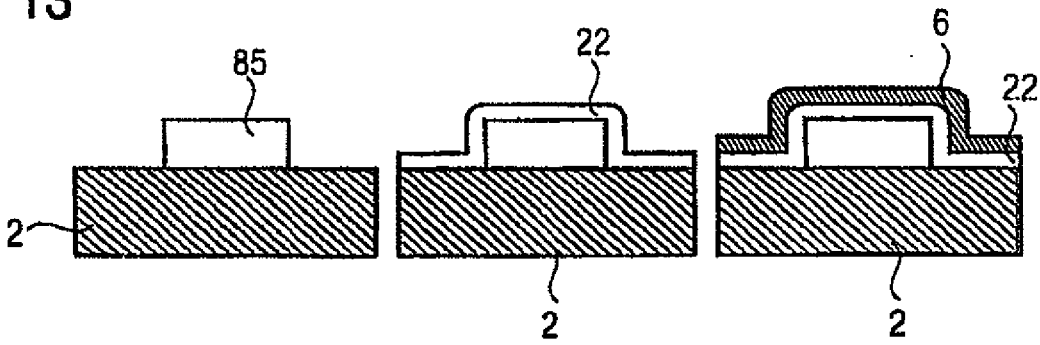
FIG. 13 shows a principle plot for manufacturing an embodiment of the present invention.

Another option also results before applying the membrane support material, in case producing corrugation grooves 34 in the membrane is desired. In this case, in a third optional step 84, a closed contour of a predetermined height of additional membrane support material can be arranged on the first main surface of the membrane carrier material in the sound transducing region, as is described referring to FIG. 13. FIG. 13 shows a sectional view of three subsequent method steps for manufacturing a corrugation groove on a carrier substrate, wherein the steps shown in FIG. 13 from the left to the right hand side represent the third optional step 84, the first step 60 and the second step 62. Thus a closed contour of a predetermined height of additional membrane support material 85 is deposited on the carrier substrate 2 on the first main surface of the membrane carrier material 22 in the sound transducing region. By subsequently applying the membrane support material 22 in the first step 60, the structure shown in the center illustration of FIG. 13 results, showing a positive shape of the corrugation groove having rounded corners. This is desirable with regard to the deforming behavior of the membrane, but not absolutely necessary. In an embodiment of the present invention, the height of the additional membrane support material is between 300 nm and 3000 nm.

The situation after applying the membrane material 6 in the second step is shown in the right illustration of FIG. 13, where it becomes clear how one or several corrugation grooves can be formed in the sound transducing region of the membrane 6 by the third optional step.

Since, as has already been mentioned, the rounded shape of the corrugation grooves is not absolutely necessary, it is also possible to perform the third optional step 84 only after the first step 60, as is indicated in FIG. 12. In one embodiment of the present invention, an oxide layer is thus dry-patterned in rings and another oxide layer is deposited to achieve rounding of the rings' edges. Thus, the geometry and the number of the rings determine the membrane's sensitivity. The membrane layer is deposited above the form resulting, as is shown in FIG. 13, so that after removing by etching the additional membrane support material 85 and the membrane support material 22, the result is a membrane comprising corrugation grooves as are illustrated in the embodiment shown in FIG. 5.

Further options or applying further optional modules in the embodiment shown in FIG. 12 result after the third step 64, namely applying the counter electrode support material. Here, the fourth step 66 of patterning the counter electrode support material 26 (with the goal of producing bumps) is already optional. Should the production of bumps be necessary, this may either be achieved in a one-step method with a fourth step 66, or a two-step method indicated in FIG. 12 may be applied, comprising a fourth optional step 86. The resulting difference of the one-step method along a path A to the two-step method along a path B is illustrated schematically referring to FIG. 14. Thus, simplistically, applying and patterning the counter electrode support material 26 are illustrated at first, wherein in the fourth step 66 the counter electrode support material is patterned by producing a plurality of recesses 88 in the sound transducing region. In the section enlargement shown in FIG. 14, the recesses 88 having a width b are illustrated in an enlarged manner to describe the geometrical shape of the recess 88 produced by etching more realistically. The width b of the recess 88 here may, for example, be in a range from 0.2 to 2 μm and in another embodiment in a range between 0.5 μm and 1.5 μm or between 0.5 μm and 3 μm. In another embodiment, the depth may be between 0.5 μm and 1.5 μm.

In the next step along the path A, the counter electrode material 4 is applied so that the result is a configuration 90*a* in which the recesses 88 are filled directly with counter electrode material. In the section enlargement shown it can be recognized that the recess 88 is completely filled with counter electrode material 4 so that the result is the configuration shown in the enlargement wherein the structure preventing the membrane 6 from sticking to the counter electrode 4 has a planar surface in the direction of the membrane 4.

If path B is taken, additional counter electrode support material 92 is applied between the counter electrode support material 26 and the counter electrode material 4 in a fourth optional step 86 so that the result is a configuration 90*b*. Thus, the geometrical dimensions of the recesses 88 may be adjusted in a controlled manner or edges of the recesses 88 may be rounded, roughly in analogy to manufacturing the corrugation grooves.

The section enlargement shown for path B thus shows another embodiment of the present invention in which, by suitably dimensioning the width b of the recess 88 and the thickness t of the additional counter electrode support material 92, the additional advantage can be achieved that the structure in the counter electrode material 4 preventing sticking to form a tip. With such a tip, sticking is prevented even more efficiently since in this case the membrane 6 and the counter electrode 4 can contact only in minimal areas.

In an embodiment of the present invention, the thickness t of the additional membrane support material 92 exemplarily is about double the width b of the recess 88 ($b \leq 2t$). The result is the configuration shown in the section enlargement having tip structures on the surface of the counter electrode 4 which can efficiently prevent membrane 6 sticking.

Figure 15:
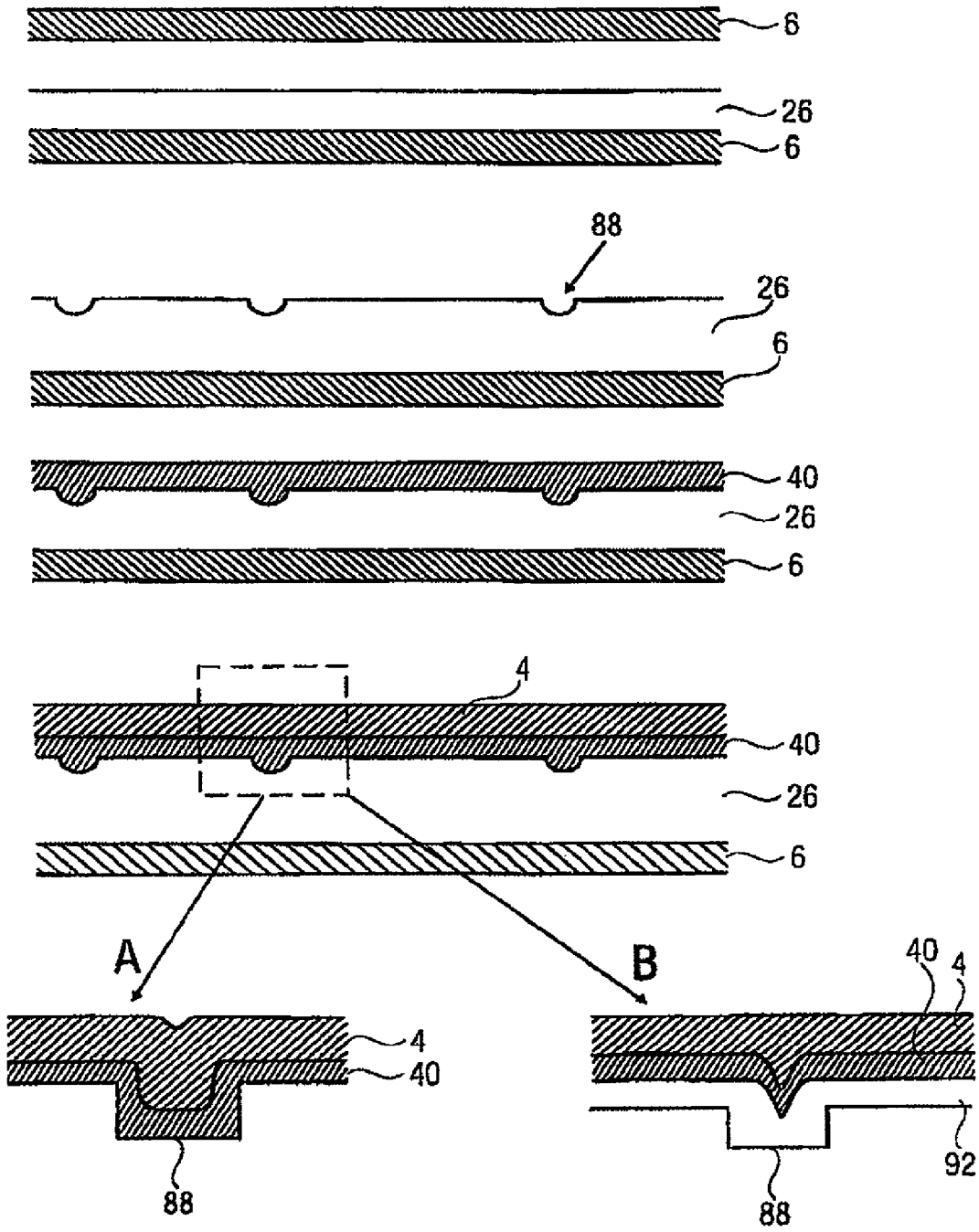
FIG. 15 shows a principle plot for manufacturing another embodiment of the present invention.

In order to obtain an embodiment of the present invention shown in FIG. 6 or implement the characteristic of the additional stability improvement material, it is possible, before the fifth step 68 of applying the counter electrode material 4, to perform a fifth optional step 94 to improve stability of the counter electrode. A principle structural view illustrating the fifth optional step 94 is shown in FIG. 15. In the fifth optional step 94, stability improvement material 40 is applied between the counter electrode support material 26 and the counter electrode material 4, wherein the stability improvement material 40 may, for example, have greater a mechanical stability than the counter electrode material 4.

Figure 14:
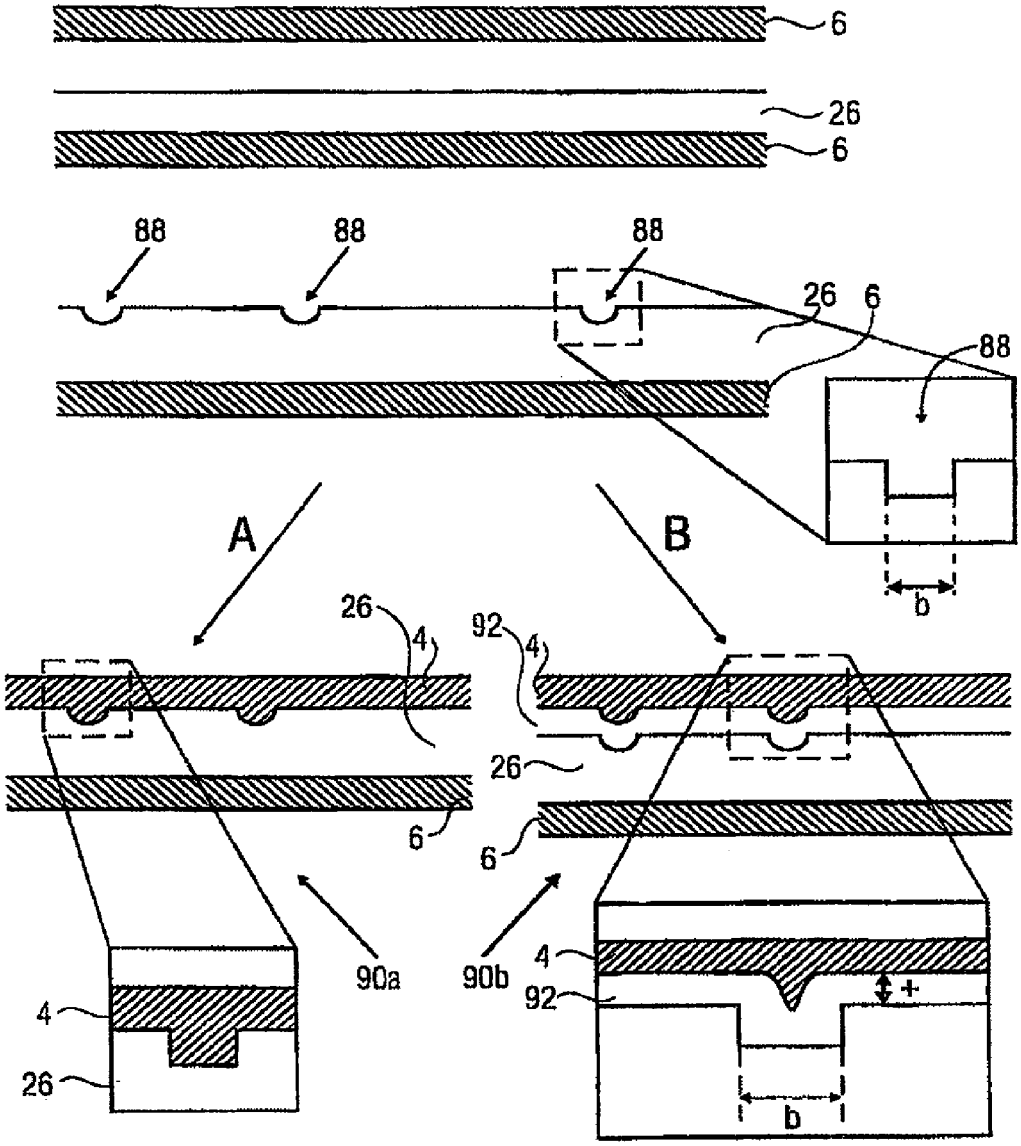
FIG. 14 shows a principle plot for manufacturing another embodiment of the present invention.

Thus, the starting position in FIG. 15 is like the one shown in FIG. 14, wherein by additionally applying the stability improvement material 40, the recesses 88 are at first filled completely or partly by the stability improvement material, before the counter electrode material 4 is applied in the fifth step 68 so that when implementing the fifth optional step 94 the result is the layer sequence schematically illustrated in FIG. 15 during the production of an embodiment of an inventive sound transducer structure. Further steps required for producing an embodiment of an inventive sound transducer structure are steps 68 and 70 already described referring to FIG. 11.

Similarly to the section enlargements already shown in FIG. 14, additional section enlargements of the structures preventing membrane 6 sticking are illustrated in FIG. 15, as result if path A or path B of FIG. 14 has been taken, before applying the stability improvement material 40. When taking path B, a tip forms in the stability improvement material 40 resulting in highly efficiently preventing membrane 6 sticking, equivalent to the case shown in FIG. 14. In case path A is taken, the recess 88 will at first be filled completely by stability improvement material 40, resulting in the nearly rectangular cross section of the anti-stick structure shown in the figure.

It is to be mentioned here that final steps may be performed after the sixth step for completing production of a functional sound transducer, which may, for example, include patterning the counter electrode material 4 to provide pressure compensation holes in the counter electrode material 4 so that the membrane 6 can directly contact the surrounding gas mixture. Further completing steps may be opening and producing contact holes for contacting, applying pads to be contacted electrically and etching the cavity from the backside or removing by etching counter electrode support material 26 and membrane support material 22 to obtain a freely movable membrane 6. Even dicing individual microphone chips from a wafer belongs to the measures mentioned here.

In summary, in an inventive embodiment of a sound transducer structure, the setup basically consists of up to three patterned polysilicon layers separated from one another by oxide layers. The membrane region on the carrier material (such as, for example, an Si wafer) is released from support by means of a dry etch method from the backside. In a last step, the membrane and the counter electrode are released from support by means of wet-chemical sacrificial layer etching of the oxide.

Conductive tracks, pads and passivations may serve electrical coupling to an ASIC for processing data and supplying a voltage, or contacting other evaluating or measuring units.

As is shown referring to FIG. 12, it is an extraordinarily great advantage of at least one embodiment of the inventive concept that individual modules or process steps may be combined in any manner when designing inventive sound transducer structures to make available a sound transducer structure optimized for the desired range of application.

Thus, the modules described again roughly below can be combined to one another to achieve an embodiment of an inventive sound transducer structure. As regards the terminology of the terms of the layers in the individual modules, reference is made to FIG. 9 showing an embodiment of the inventive concept using a specific implementation having polycrystalline silicon and silicon oxide. The modules are subsequently arranged for an exemplary process flow of manufacturing a sound transducer structure including additional corrugation in the membrane:

- wafer
- module 1: poly1—precise membrane diameter ("substructure")
  - depositing an oxide layer 1 for the etch stop of etching the cavity (300 nm TEOS)
  - depositing the poly1 layer (300 nm)
  - implantation (phosphorus)
  - crystallization
  - patterning the poly1
- module 2: corrugation grooves
  - depositing an oxide layer 2 (600 nm)
  - patterning the oxide layer to form corrugation grooves
- module 3: poly2-membrane
  - depositing an oxide layer 3 as an etch stop and intermediate layer to poly1 and, if necessary, for rounding the bumps (300 nm)
  - depositing the membrane poly (300 nm)
  - implantation (phosphorus)
  - crystallization
  - patterning the poly2 to form the membrane and, if applicable, guard ring
- module 4: sacrificial layer—gap distance—bumps
  - depositing an oxide 4 (2000 nm)
  - patterning holes as a pre-form of the bumps (diameter 1 μm, depth 0.7 μm-1 μm)
  - depositing another 600 nm of oxide 4 for adjusting the sacrificial layer thickness and the gap distance, at the same time the shape for the pointed bump is defined
- module 5: back plate
  - depositing an SiN layer for the case of a considerably stiffened counter electrode
  - depositing the counter electrode poly3 (800-1600 nm)
  - implantation (phosphorus)
  - crystallization patterning the poly3 to form the counter electrode and perforation subsequent patterning of the oxide stack of the gap distance module 6: metallization/passivation depositing an intermediate oxide and, if applicable, flowing or CMP for leveling the topology or rounding edges patterning and opening contact holes on the substrate, poly1, poly2 and 3 depositing and patterning a metallization for conductive tracks and pads depositing the passivation opening the passivation via pads and membrane region module 7: MEMS etching the cavity on the backside of the wafer definition of a resist layer on the front side having an opening above the membrane region sacrificial layer etching of the oxide and the etch stop layer in an etching mixture containing hydrofluoric acid, rinsing, resist removing and drying Dicing the Wafer Into Individual Microphone Chips The inventive concept or the inventive method is not limited in its application to the manufacturing of microphones alone although it has been illustrated before predominantly using silicon microphone.

The inventive concept may be applied to any other fields where measuring a pressure difference is important. Thus, in particular absolute or relative pressure sensors or pressure sensors for liquids including the inventive concept may also be configured or produced flexibly.

Also, inventive sound or pressure transducers may be used for generating sound, i.e., for example, as loudspeakers, or for producing a pressure in a liquid.

While this invention has been described in terms of several preferred embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations, and equivalents as fall within the true spirit and scope of the present invention.

The invention claimed is:

1. A sound transducer structure, comprising:

a membrane comprising a first main surface, the first main surface of the membrane made of a membrane material in a sound transducing region and an edge region;

a counter electrode made of counter electrode material, the counter electrode comprising a first main surface and a second main surface, the second main surface of the counter electrode arranged in parallel to the first main surface of the membrane on a side of a free volume opposite the first main surface of the membrane; and stability improvement material arranged on the second main surface of the counter electrode material, the stability improvement material comprising a greater mechanical stability than the counter electrode material.

2. The sound transducer structure according to claim 1, wherein a ratio of the thickness of the stability improvement material and the counter electrode material is between 1:100 and 1:1.

3. The sound transducer structure according to claim 1, wherein the stability improvement material is silicon nitride, silicon oxy nitride or metal silicide.

4. The sound transducer structure according to claim 1, additionally comprising:

a plurality of elevations extending in the sound transducing region from the second main surface of the counter electrode into the free volume.

* * * * *